US005931443A

United States Patent [19]

Corte, Sr.

[11] Patent Number: 5,931,443

[45] Date of Patent: Aug. 3, 1999

[54] METHOD OF REBUILDING ANNULAR-TYPE BLOW OUT PREVENTER

[75] Inventor: Bobby Corte, Sr., Houma, La.

[73] Assignee: Cor-val Services, Inc.

[21] Appl. No.: 09/075,558

[22] Filed: May 1, 1998

[51] Int. Cl.[6] ..... E21B 33/06

[52] U.S. Cl. ..... 251/1.2; 29/890.121

[58] Field of Search ..... 251/1.2; 29/890.121

[56] References Cited

U.S. PATENT DOCUMENTS 4,718,495 1/1988 Lubitz et al. ..... 251/1.2 X

*Primary Examiner*—John Fox

*Attorney, Agent, or Firm*—Garvey, Smith, Nehrbass & Doody, L.L.C.

[57] ABSTRACT

A method of rebuilding an annular blow out preventer of the type having a head with threads that attach it to the body of the blow out preventer involves the removal of about 1 to 1½) of the threads (e.g., if total thread revolutions equal seven (7) revolutions) closest to the internal bore and piston of the apparatus. An annular groove is formed at the interface between the head and the body. An annular seal, preferably a lip type seal, is positioned at this interface at the annular groove. The seal isolates the threads from the upper hydraulic chamber that is used to move the piston portion of the apparatus. This method prevents contamination and/or corrosion of the threads.

12 Claims, 4 Drawing Sheets

METHOD OF REBUILDING ANNULAR-TYPE BLOW OUT PREVENTER

REFERENCE TO A "MICROFICHE APPENDIX"

Not applicable.

CROSS-REFERENCE TO RELATED APPLICATIONS

Not applicable.

STATEMENT REGARDING REDERALLY SPONSORED RESEARCH OR DEVELOPMENT

Not applicable.

BACKGROUND OF THE INVENTION

1. Field of the Invention

The present invention relates to annular-type blow out preventers, and more particularly to an improved annular blow out preventer arrangement with a body and head that are threadably engaged and a sealing arrangement prevents corrosive attack to the threads that join the head and body, an area typically attacked during use. Even more particularly, the present invention relates to an improved annular-type blow out preventer having a moving piston that forces a packing unit into close engagement with a drill pipe and wherein a method of preventing corrosive attack removes one or more threads from the threaded connection that joins the head to the body and replaces those threads with a one-way or lip-type annular seal.

2. General Background of the Invention

Blow out preventers have long been used in the oil and gas well drilling industry to prevent a catastrophic blow out condition. Such a blow out condition can occur when a well is not maintained by well drilling fluids in proper hydrostatic balance. Down hole well pressure can overcome the hydrostatic pressure of drilling mud or like drilling fluid within the well. In such a situation, a blow out preventer closes the well bore to contain pressure and prevent a "blow out".

One of the most common types of blow out preventers is an annular-type blow out preventer that surrounds the drill pipe with a housing. Such devices have been sold commercially since the 1950's. One manufacturer sells these "BOPs" under the mark Hydril®. In order to access the central working portion of the apparatus (e.g., piston and packing unit), an upper head threadably engages and attaches to a lower body.

Examples of early blowout preventer constructions can be seen in the Allen patents 2,752,119 and 2,912,214. Another prior art example is U.S. Pat. No. 3,272,222 also issued to H. Allen, entitled "Blowout Preventer".

U.S. Pat. No. 3,561,723, issued to Edward T. Cugini, discloses a stripping blowout preventer device for use in well drilling operations, particularly in offshore subsea well drilling, to prevent fluid escaping from the well in the presence or absence of a well tool such as a pipe string, while rotating or stationary, or during removal of the string from the well hole.

U.S. Pat. No. 3,614,111, issued to John Regan, shows a stationary blowout preventer having a balloon-type packing unit with a central opening therein, a retrievable packing insert positioned within said opening by the engagement of a lower ring with the preventer and releasably secured therein by hydraulically releasable dogs latchingly engaging a latching notch in an upper ring, whereby a central rubber portion of the packing insert sealingly engages the pipe tool therethrough when the packing unit is pressurized by fluid. The blowout preventer has a fluid accumulator which absorbs the surge pressure and excess fluid to maintain a constant pressure on the packing insert as a pipe tool joint is stripped therethrough to maintain the sealing engagement between the insert and the pipe.

U.S. Pat. No. 3,647,174, issued to Robert K. LeRouax, discloses a blowout preventer of the ram-type, each having a bonnet which is detachably connected to the preventer body, and which bonnet is movable away from the preventer body to expose the ram therewith for permitting removal of the ram from the preventer for replacement or repair, wherein the ram piston and cylinder which are operable for moving the ram to and from its open and closed positions when the bonnet is secured to the preventer body are also operable for moving the bonnet away from and towards the preventer body when the bonnet is disconnected from the body.

U.S. Pat. No. 3,741,296, issued to F. Murman et al., discloses a method and apparatus to enable well blowout preventer packer replacement at a sub-sea well head location.

U.S. Pat. No. 3,744,749, issued to Robert LeRouax, shows a blowout preventer having new and improved means for supporting and guiding each ram in its travel to and from the open and closed positions whereby more uniform support, anti-cocking, and anti-heeling of the ram during such travel are accomplished.

U.S. Pat. No. 4,007,905, issued to James D. Mott, discloses retrievable blowout preventer ram seals which are adapted to be removed and/or inserted with apparatus working on the inside of the well pipe.

Over a long period of time, the hydraulic fluid can contain small metallic shavings and other contaminants and/or corrosive material that are generated by cyclical movement of the piston. Such corrosives and contaminants can attack the threaded connection that joins the head to the body. Over time, this corrosive attack can be so severe that the head and body appear to be welded together. In such a situation, even very large hydraulic jacks can not break the threads loose and the entire apparatus is ruined. Annular-type blow out preventers are very expensive, costing, for example, between $50,000–$100,000. When the head becomes permanently attached to the body because of corrosive attack, the blow out preventer is not repairable and must be junked.

BRIEF SUMMARY OF THE INVENTION

The present invention provides an improved annular-type blow out preventer and method of modifying existing blow out preventers that include an annular body and a head that threadably attaches to the body. The method of the present invention provides an improved method of modifying an existing blow out preventer that includes an annular body and an upper head portion that threadably attaches to the body with removal of some threads (usually 1–1½) to be replaced by a seal arrangement. The body has upper and lower hydraulic chambers that accept pressurized fluid that drive a piston to close a packing unit against the drill pipe and seal the well.

The method of the present invention provides a modification to the head and body at the threaded connection by first removing some of the threaded connection that joins the head and the body. This threaded portion that is removed is replaced with a smooth cylindrically-shaped surface.

An annular groove is milled into the body at the cylindrically-shaped surface to provide a location for the placement of a one-way or "lip" seal. The annular lip seal member is placed into the annular groove at the position of the removed threads.

The annular seal blocks fluid flow from the upper hydraulic chamber to the threaded connection that joins the body and head. The blow-out preventer includes such hydraulic chambers for moving the piston portion thereof between engaged and disengaged positions.

The annular seal and threaded connection maintain a working pressure between about 1,500 and 10,000 p.s.i.

In the preferred method, the step of removing some of the threaded connection includes removing at least one revolution of the threaded connection.

The method can include the removal of between one and one and one-half revolutions of the threaded connection that includes usually about seven (7) thread revolutions.

In the preferred embodiment, the threaded connection that joins the head and body includes a plurality of between about 5 and 10 thread revolutions. In the method of the present invention, between about 5% and 20% of these threads are removed in order to form a smooth cylindrically-shaped surface that carries the lip tight seal.

The annular seal is preferably placed above the hydraulic chambers that are used to move the piston of the blow out preventer.

There are ports provided for adding hydraulic fluid to the hydraulic chambers of the blow out preventer that are used to move the piston between engaged and disengaged positions. The method of the present invention further comprises the step of positioning the seal member in between one of the ports and the threaded connection.

In the preferred method, there are a pair of ports for respectively adding hydraulic fluid to the upper and lower hydraulic chambers of the blow out preventer. The annular seal member is preferably positioned in between the upper port and the threaded connection that joins the head and the body.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
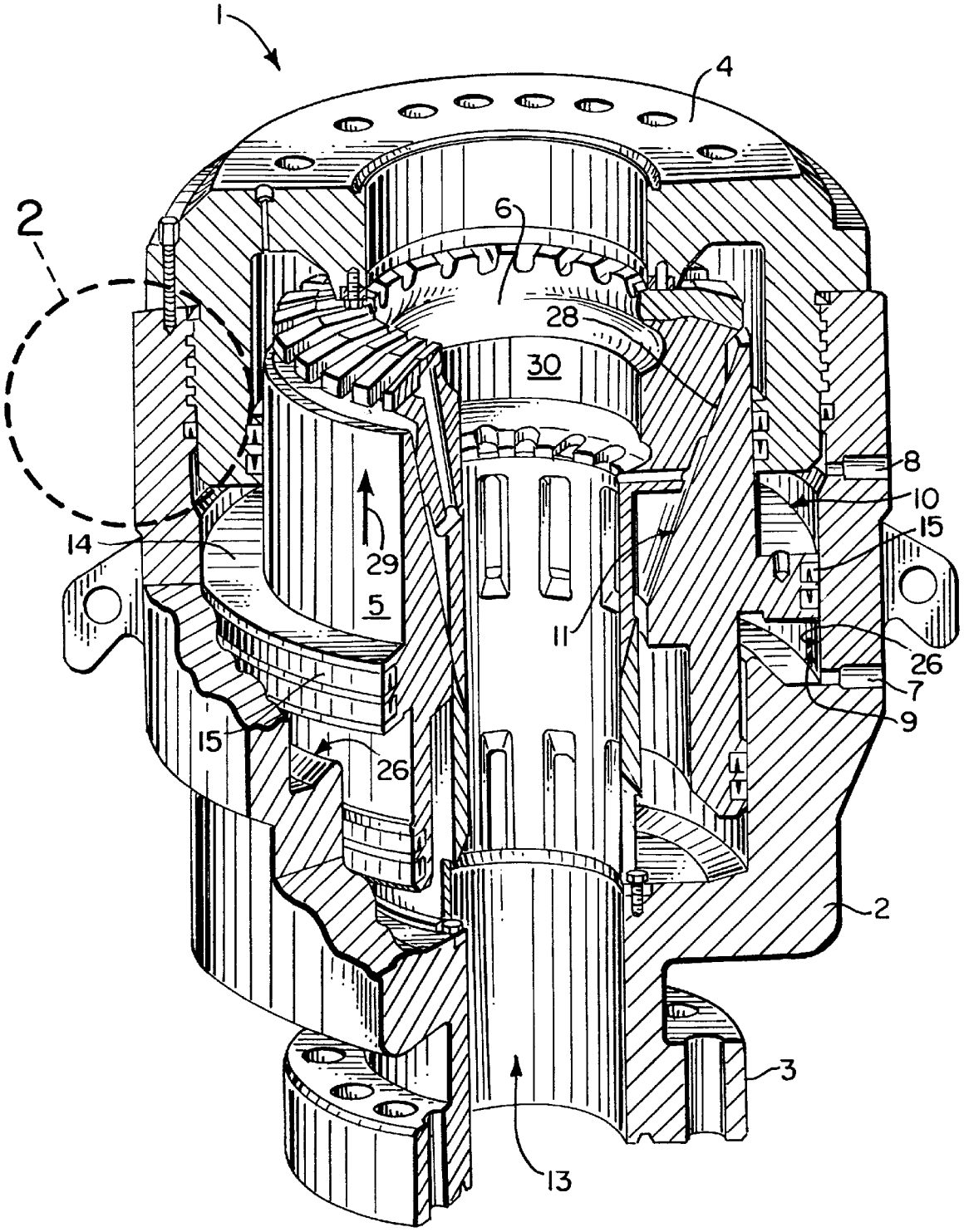
FIG. 1 is a perspective view of the preferred embodiment of the apparatus of the present invention.

FIG. 1 shows the preferred embodiment of the annular blow out preventer designated generally by the numeral 1. Blow out preventer 1 has a large body 2 having a lower flange 3 for enabling the body 2 to be bolted into position at a well head. An upper head 4 is threadably attached to the body 2. The blow out preventer 1 can have flange 3 through bore sizes of between four and seventeen inches, typically sizes of 4 1/16", 7 1/16", 11", 13 5/8", and 16 3/4".

Within the interior of the body 2, a piston 5 is movably disposed to slide between upper and lower positions. The piston 5 has an angled or inclined annular surface 11 that engages packing unit 6. When the piston 5 moves up, the packing unit 6 is compressed and urged inwardly to squeeze drill pipe that occupies central bore 13. A pair of hydraulic ports 7, 8 are used to move the piston 5 between its upper and lower positions.

The port 7 is a lower port that communicates with lower hydraulic chamber 9. The port 8 is an upper port that communicates with upper hydraulic chamber 10. Piston 5 includes an annular radially extending portion 14 that forms a division separating lower hydraulic chamber 9 from upper hydraulic chamber 10.

Vertical bore 13 enables a length of drill pipe to pass through the center of body 2, piston 5, and packing unit 6 during drilling operations. Blow out preventer 1 and the surrounded drill pipe are so positioned during use, that packing unit 6 can be constricted with piston 5 so that sealing surface 30 of packing unit 6 engages and conforms to the drill pipe to prevent a blow out condition. In such a situation, well bore pressure is held by the blow out preventer 1 at flanged connection 3 (which connects the body 2 to the well head) and the constricted packing unit 6 that engages the drill pipe with sealing surface 30 of packing unit 6.

Piston 5 has an inclined surface 11 that engages and conforms to a similarly inclined surface 28 of packing unit 6. As the piston 5 moves upwardly in the direction of arrow 29, the packing unit 6 is constricted so that the surface 30 engages the drill pipe. Piston 5 includes radially extending portion 14 having a pair of annular seals 15 that enable it to form a seal with internal wall 26 of body 2.

Figure 2:
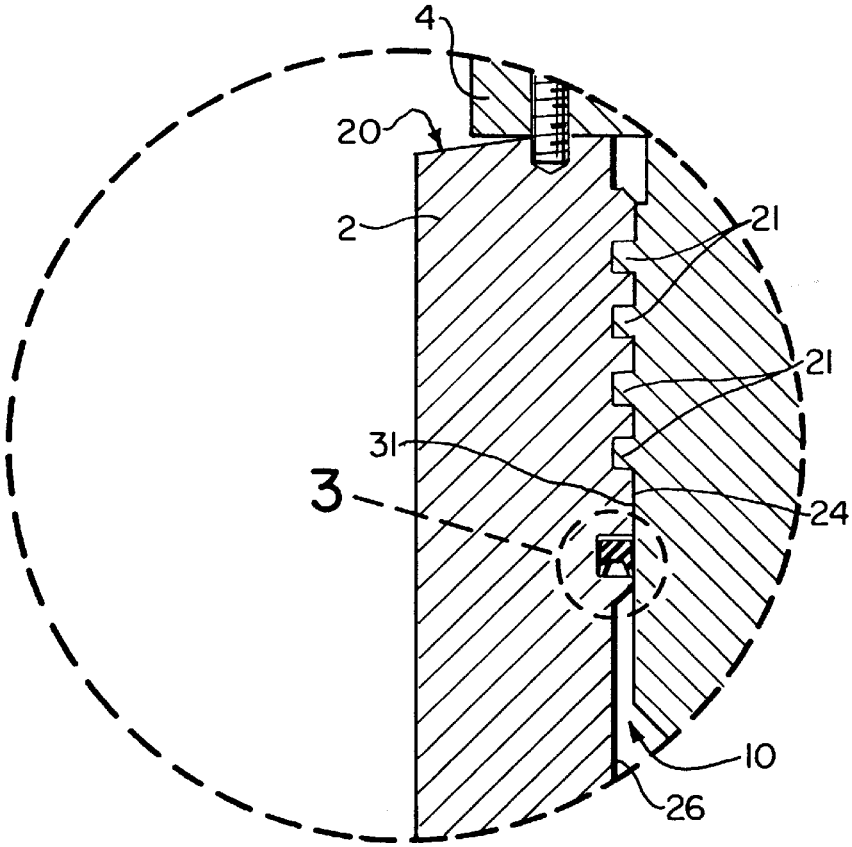
FIG. 2 is a sectional elevational view of the preferred embodiment of the apparatus of the present invention.
Figure 8:
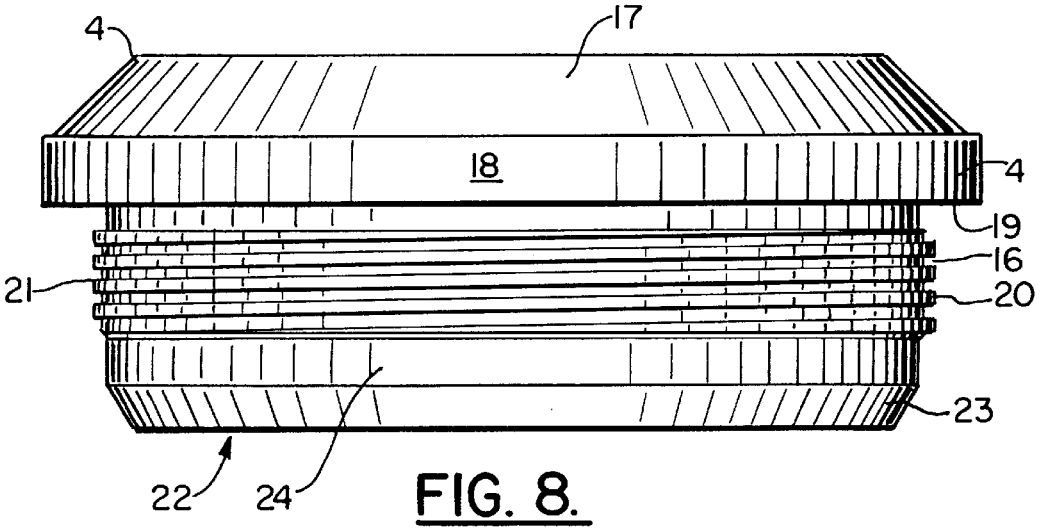
FIG. 8 is a partial elevational view of the preferred embodiment of the apparatus of the present invention illustrating the head portion thereof.

In FIG. 8, head 4 is shown removed from blow out preventer 1 to expose its outer surfaces. Head 4 thus includes an upper section 17, lower section 16, and an enlarged diameter central section 18. Annular shoulder 19 is provided on the lower side of enlarged diameter central section 18. This annular shoulder 19 engages and abuts the annular shoulder 20 that is at the top of body 2. The engaging arrangement of surfaces 19, 20 is shown in FIGS. 1 and 2.

Figure 7:
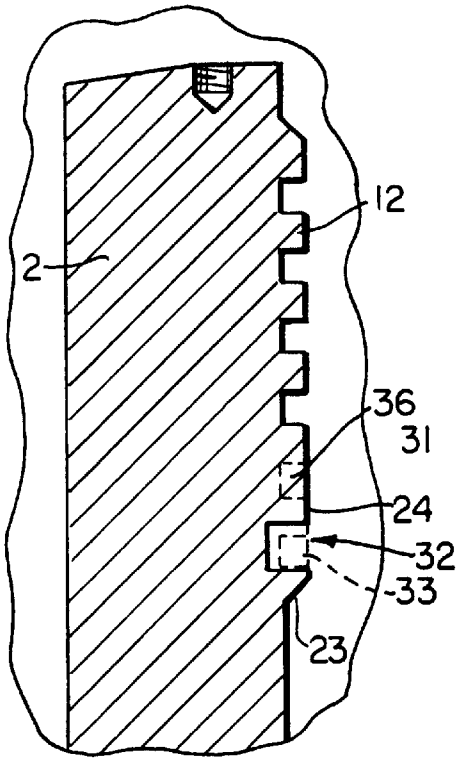
FIGS. 6 and 7 are partial sectional elevational views that illustrate some of the method steps for modifying an existing blow out preventer to protect the threaded connection between head and body portions.
Figure 6:
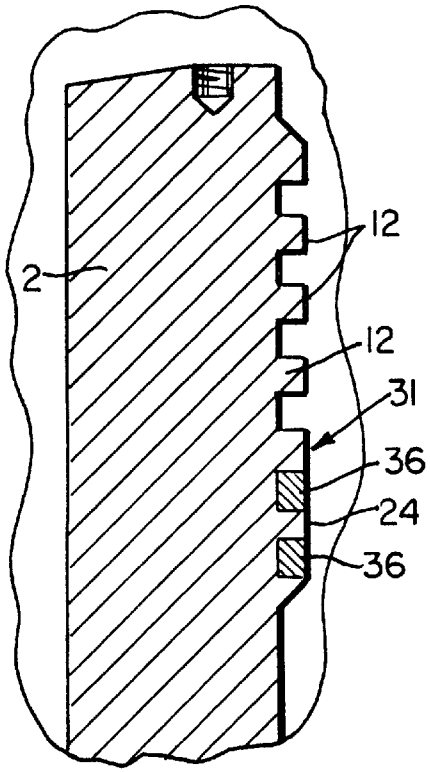

The lower section 16 of head 4 includes a continuous external thread 21 that is typically between about 6 and 10 revolutions or threads. For modifying existing blow out preventers, the method of the present invention removes some threads 21 from head 4. Similarly, some internal threads 12 at the top of body 2 are removed (see FIGS. 2 and 6–9). With the method of the present invention, some of the lowermost thread portions 12, 21 are removed to provide a smooth uninterrupted cylindrical section 24 on head 4 as shown in FIGS. 6–8. The smooth cylindrically-shaped section 24 on head 4 is positioned just above frustoconical section 23 and lower surface 22.

Similarly, the continuous thread 12 on body 2 is removed by filling in with welded consumables 36 for example (see FIG. 6) to form a smooth cylindrically-shaped surface 31. Upon assembly, the frustoconical portion 23 is positioned next to upper port 8, as shown in FIG. 1.

Figure 5:
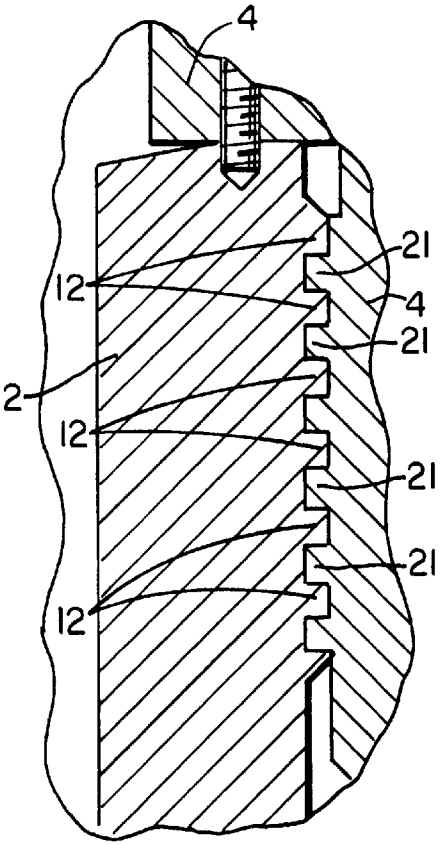
PRIOR ART FIG. 5.
FIG. 5 is a partial sectional elevational view of a prior art-type blow out preventer showing the threaded connection that joins the head and body.
Figure 9:
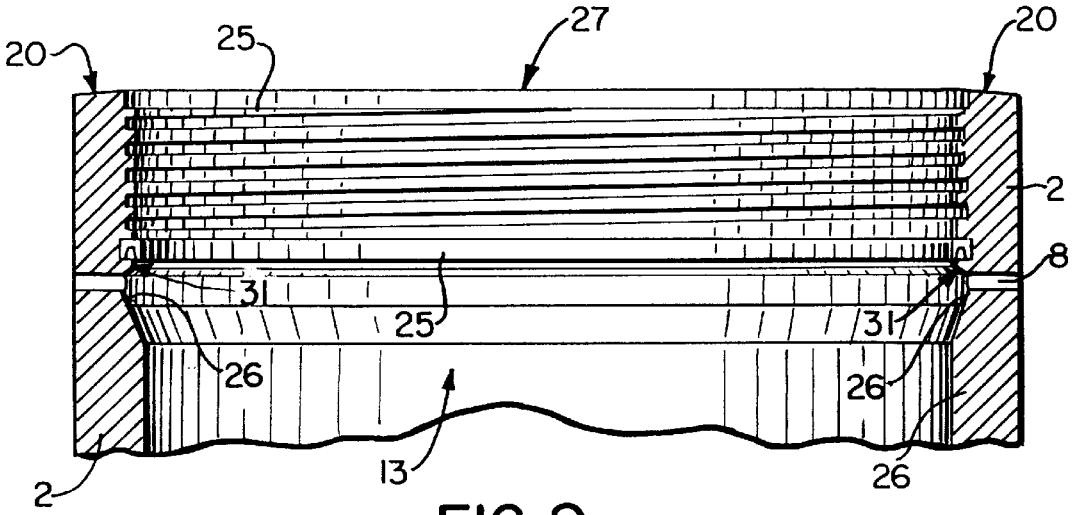
FIG. 9 is a partial elevational view of the preferred embodiment of the apparatus of the present invention illustrating the body portion thereof.

In FIG. 9, body 2 is shown with head 4 removed. Body 2 provides an open chamber 27 that receives piston 5 and packing unit 6. Annular shoulder 20 is at the upper end of body 5. The inner surface of body 5 just below annular shoulder 20 is internally threaded at section 25 with continuous thread 12 as shown in FIG. 5. Just below the internally threaded section 25, there is provided a smooth internal wall 26 beginning at a position next to upper port 8 and proceeding downwardly until lower port 7 is reached as shown in FIGS. 1–2 and 9.

Once the smooth, cylindrically-shaped surfaces 24 and 31 are formed respectively on head 4 and on body 2, an annular groove 32 is milled in body 2 as shown in FIGS. 2–3 and 6–7. The groove 32 is positioned in between threaded section 25 of body 2 (once threads are removed) and upper port 8.

Figure 3:
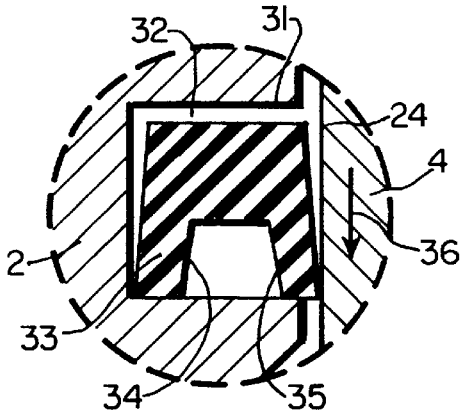
FIG. 3 is a fragmentary sectional elevational view of the preferred embodiment of the apparatus of the present invention.
Figure 4:
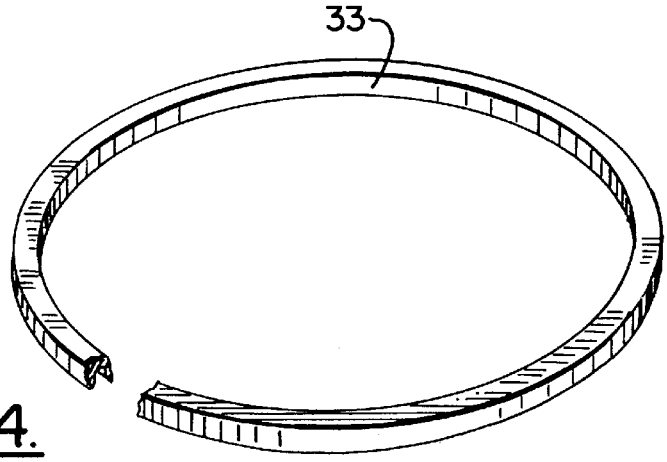
FIG. 4 is a fragmentary perspective view of the preferred embodiment of the apparatus of the present invention showing the annular lip-type seal portion thereof.

Annular seal 33 (see FIGS. 2–4) is preferably a lip type seal that allows fluid flow in the direction of arrow 36 in FIG. 3, from threads 12, 21 toward upper chamber 10. However, pressurized fluid flow is not allowed in the opposite direction, from upper chamber 20 toward threads 12, 21. Thus, fluid flow is permitted in a downward direction, but disallowed in an upward direction. Sealing members 34, 35 of lip seal 33 spread apart when pressure attempts to force fluid from chamber 10 toward threads 12, 21.

The present invention thus provides an improved method and apparatus for protecting a blow out preventer that must operate in working pressures (i.e., well blow out pressures) of between about 1,500 p.s.i. and 10,000 p.s.i. The apparatus 1 can be an as-built newly manufactured blow out preventer or a modified blow out preventer that has been reconstructed using the method of the present invention.

The following table lists the parts numbers and parts descriptions as used herein and in the drawings attached hereto.

PARTS LIST

| Part Number | Description |
|---|---|
| 1 | blow out preventer |
| 2 | body |
| 3 | flange |
| 4 | head |
| 5 | piston |
| 6 | packing unit |
| 7 | port |
| 8 | port |
| 9 | lower hydraulic chamber |
| 10 | upper hydraulic chamber |
| 11 | inclined annular surface |
| 12 | continuous thread |
| 13 | bore |
| 14 | radially extending portion |
| 15 | annular seals |
| 16 | lower section |
| 17 | upper section |
| 18 | enlarged diameter central section |
| 19 | annular shoulder |
| 20 | annular shoulder |
| 21 | continuous thread |
| 22 | lower surface |
| 23 | frustoconical portion |
| 24 | cylindrical section |

-continued

PARTS LIST

| Part Number | Description |
|---|---|
| 25 | internally threaded section |
| 26 | internal wall |
| 27 | open chamber |
| 28 | inclined surface |
| 29 | arrow |
| 30 | sealing surface |
| 31 | cylindrically-shaped surface |
| 32 | annular groove |
| 33 | annular lip seal |
| 34 | sealing member |
| 35 | sealing member |
| 36 | welded consumables |

The foregoing embodiments are presented by way of example only; the scope of the present invention is to be limited only by the following claims.

I claim:

1. A method of modifying an existing blow out preventer having an annular body and head threadably attached to the body, the body having a packing element, a piston that moves between opening and closing positions and a pair of hydraulic chambers for opening and closing the packing element about drill pipe to prevent a blowout, said method comprising the steps of:

a) removing some of the threaded connection that joins the head and body;

b) placing an annular seal member at the position of the removed threads;

c) using the annular seal member to block fluid flow from one of the hydraulic chambers to the threaded connection; and d) wherein said annular seal and threaded connection maintains a working well bore pressure between about 1,500–10,000 p.s.i.

2. The method of claim 1 wherein said annular seal and threaded connection maintain a working well bore pressure of between about 5,000–10,000 psi.

3. The method of claim 1 further comprising the step of maintaining a working well bore pressure of about 10,000 psi.

4. The method of claim 1 wherein in step "a" at least one revolution of the threaded connection is removed.

5. The method of claim 1 wherein in step "a" between one and one and one-half revolutions of said threaded connection is removed.

6. The method of claim 1 further comprising the step between steps "a" and "b" of milling an annular groove in the head portion of the blowout preventer and placing said seal member in the annular groove to form said seal in step "b".

7. The method of claim 1 further comprising the step of positioning the seal member above the hydraulic chambers.

8. The method of claim 1 wherein there are ports for adding hydraulic fluid to the hydraulic chambers of the blowout preventer and further comprising the step of positioning the seal member in between the ports and the threaded connection.

9. The method of claim 1 wherein there are ports for adding hydraulic fluid to the hydraulic chambers of the blowout preventer including a lower port and an upper port and further comprising the step of positioning the seal member in between the upper port and the threaded connection.

10. A method of modifying an existing blow out preventer having an annular body and a head threadably attached to the upper end of the body, the body having a bore and an internally carried packing element held within the body bore, a piston that moves within the bore between opening and closing positions and a pair of hydraulic chambers for moving the piston to open and close the packing element about a section of drill pipe to prevent a blowout, said method comprising the steps of:

a) removing some of the threaded connection that joins the head and body;

b) placing an annular seal member at the position of the removed threads;

c) using the annular seal member to block fluid flow from one of the hydraulic chambers to the threaded connection; and d) wherein said annular seal and threaded connection maintain an internal blowout preventer working pressure between about 1,500–10,000 psi.

11. The method of claim 10 wherein the head and body are joined at correspondingly shaped cylindrical surfaces the carry respective engaging thread portions, and further comprising the step of placing the seal at one of the cylindrical surfaces.

12. The method of claim 11 wherein the head and body are joined at correspondingly-shaped cylindrical surfaces the carry respective engaging thread portions, and further comprising the step of forming an annular groove in one of the cylindrically-shaped surfaces and placing the seal in the annular groove.

* * * * *